US007704930B2

(12) United States Patent
Deckman et al.

(10) Patent No.: US 7,704,930 B2
(45) Date of Patent: Apr. 27, 2010

(54) MIXED TBN DETERGENTS AND LUBRICATING OIL COMPOSITIONS CONTAINING SUCH DETERGENTS

(75) Inventors: Douglas E. Deckman, Mullica Hill, NJ (US); Mark D. Winemiller, Clarksboro, NJ (US); William L. Maxwell, Pilesgrove, NJ (US); William H. Buck, West Chester, PA (US); David J. Baillargeon, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 984 days.

(21) Appl. No.: 11/333,056

(22) Filed: Jan. 17, 2006

(65) Prior Publication Data

US 2006/0116302 A1 Jun. 1, 2006

Related U.S. Application Data

(63) Continuation of application No. 10/353,170, filed on Jan. 28, 2003, now abandoned.

(60) Provisional application No. 60/353,737, filed on Jan. 31, 2002.

(51) Int. Cl.
*C10M 159/22* (2006.01)

(52) U.S. Cl. ..... 508/460

(58) Field of Classification Search ..... 508/460
See application file for complete search history.

(56) References Cited

U.S. PATENT DOCUMENTS 6,191,081 B1 * 2/2001 Cartwright et al. ..... 508/460

* cited by examiner

*Primary Examiner*—Glenn A Caldarola
*Assistant Examiner*—Taiwo Oladapo
(74) *Attorney, Agent, or Firm*—Gary P. Katz

(57) ABSTRACT

The present invention concerns a detergent additive for lubricating oil compositions comprising at least two of low, medium, and high TBN detergents. Preferably the detergent is a calcium salicylate. The present invention also concerns lubricating oil compositions comprising such detergents, and at least one of Group II base stock, Group III base stock, or wax isomerate base stock.

13 Claims, 8 Drawing Sheets

MIXED TBN DETERGENTS AND LUBRICATING OIL COMPOSITIONS CONTAINING SUCH DETERGENTS

This application is a Continuation Under 37 C.F.R. §1.53 (b) of Non-Provisional U.S. Ser. No. 10/353,170 filed Jan. 28, 2003 and abandoned on Jun. 6, 2006 and based on Provisional 60/353,737 filed Jan. 31, 2002.

BACKGROUND OF THE INVENTION

1. Field of the Invention

This invention relates to lubricating oil compositions suitable for use in internal combustion engines.

2. Background

Contemporary lubricants such as engine oils use mixtures of additives such as dispersants, detergents, inhibitors, viscosity index improvers and the like to provide engine cleanliness and durability under a wide range of performance conditions of temperature, pressure, and lubricant service life.

Lubricating oil compositions use a variety of detergents to minimize varnish, ring zone deposits, and rust by sobulizing oil insoluble particles. Overbased detergents are used to help neutralize acids that accumulate in lubricating oil during use.

A typical detergent is an anionic material that contains a long chain oleophillic portion of the molecule and a smaller anionic or oleophobic portion of the molecule. The anionic portion of the detergent is typically derived from an organic acid such as a sulfur acid, carboxylic acid, phosphorous acid, phenol, or mixtures thereof. The counter ion is typically an alkaline earth or alkali metal. Salts that contain a substantially stochiometric amount of the metal are described as neutral salts and have a total base number (TBN; measured by ASTM D2896, TBN is defined as mg KOH/g) of from about 0 to 80. Many compositions are overbased, containing large amounts of a metal base that is achieved by reacting an excess of a metal compound (a metal hydroxide or oxide, for example) with an acidic gas (such as carbon dioxide). The resulting overbased detergent is an overbased detergent that will typically have a TBN of 150 or higher, often 250 to 450 or more.

Typical detergents include the alkali or alkaline earth metal salts of sulfates, phenates, carboxylates, phosphates, and salicylates.

U.S. Pat. No. 5,458,790 discloses preparation and use of alkaline earth metal hydrocarbyl salicylate detergents with a TBN of 300 or more. Japanese Patent Application 10053784-A describes a lubricating oil composition for diesel engines which contains base oil, 0.04-0.2 weight percent calcium as calcium salicylate with a basicity of 100 mg KOH/g or higher, 0.01-0.1 weight percent calcium salicylate or calcium phenate with a basicity of less than 100 mg KOH/g, and at least 0.02 weight percent nitrogen as polyalkenyl succinimide.

With engines increasingly demanding higher performance, there is a need for detergents that provide increased friction reduction, detergent film maintenance, and engine cleanliness.

SUMMARY OF THE INVENTION

The present invention achieves the above objectives by providing a detergent additive for lubricating oil compositions comprising at least two detergents with substantially different total base number (TBN). In one embodiment, the detergent additive comprises at least two of the following: a detergent of greater than about 200 TBN, a detergent of about 100 to 200 TBN, and a detergent of less than about 100 TBN.

In one embodiment, all three detergents are used. In another embodiment, the detergents are salicylate detergents. The present invention also concerns lubricating oil compositions containing such detergents and at least one of Group II base stock, Group III base stock, Group IV base stock, and wax isomerates, and mixtures thereof.

BRIEF DESCRIPTION OF THE DRAWINGS

In FIGS. 1-8, the detergents described contain approximately 50% process oil.

DETAILED DESCRIPTION OF THE INVENTION

Figure 1:
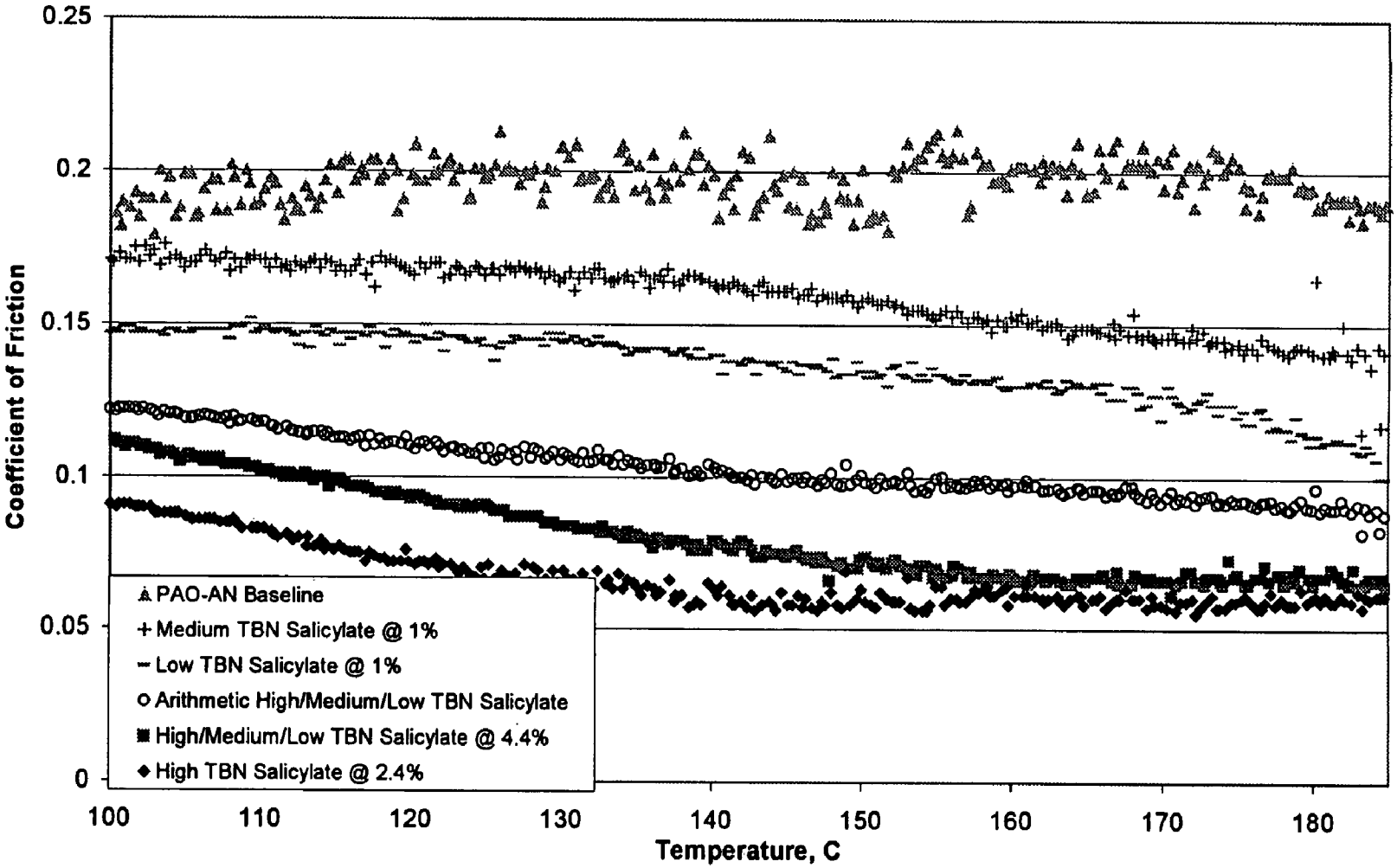
FIG. 1 is a graphical representation of coefficient of friction data for a lubricant mixture containing high, medium, and low TBN salicylates.

Engine oils contain a base lube oil and a variety of additives. These additives include detergents, dispersants, friction reducers, viscosity index improvers, antioxidants, corrosion inhibitors, antiwear additives, pour point depressants, seal compatibility additives, and antifoam agents. To be effective, these additives must be oil-soluble or oil-dispersible. By oil-soluble, it is meant that the compound is soluble in the base oil or lubricating oil composition under normal blending conditions. All percentages of ingredients in the specification are weight percentages unless it is noted otherwise.

In one aspect, the present invention concerns a detergent additive useful in lubricating oil compositions comprising a mixture of salicylate detergents of varying total base number (TBN). By using mixtures of at least two of high, medium, and low TBN detergents, preferably in the presence of hydrocarbyl aromatics, unexpected improved cleanliness, film forming and friction reducing properties are seen. These synergistic improvements are particularly significant within narrow concentration ranges when test results are compared to the individual components, or to properties that should be provided by an arithmetic mean of such components. In one preferred mode, mixtures of low, medium, and high TBN detergents are used. Preferably the detergent is a salicylate detergent, more preferably a calcium salicylate detergent.

Within the scope of the present invention, a low TBN detergent is defined as having a TBN of less than about 100. A medium TBN detergent is defined as having a TBN of between about 100 and 200. A high TBN detergent is defined as having a TBN of greater than about 200.

Low TBN refers to neutral to low-overbased detergents, medium TBN refers to medium overbased-detergents and high TBN refers to high-overbased detergents. These terms are used descriptively to describe the general differences between the total base numbers (TBN) of the detergents used and are meant to describe in general terms the differences between the contained calcium levels and the presence or absence and/or the degree of overbasing derived by the carbonation of the calcium salicylate in the presence of excess (over and beyond stoichiometric quantities) of calcium bases to form overbased calcium carbonate complexed calcium salicylate detergents.

Salicylate detergents may be prepared by reacting a basic metal compound with at least one salicylic acid compound and removing free water from the reaction product. Useful salicylates include long chain alkyl salicylates. One useful family of compositions is of the formula

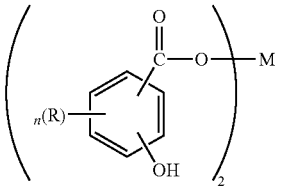

where R is a hydrogen atom or an alkyl group having 1 to about 30 carbon atoms, n is an integer from 1 to 4, and M is an alkaline earth metal. Preferred are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791, which is incorporated herein by reference in its entirety, for additional information on synthesis of these compounds. The metal salts of the hydrocarbyl-substituted salicylic acids may be prepared by double decomposition of a metal salt in a polar solvent such as water or alcohol.

In another preferred embodiment, the mixed TBN detergents of the present invention are incorporated into lubricating oil compositions. In one preferred mode, at least two of about 0.2% to about 4% of low TBN detergent, about 0.2% to about 4% of medium TBN detergent and about 0.2% to about 4% of high TBN detergent (all percentages based on total weight of the lubricating oil composition and based on an active ingredient basis which excludes oil diluents and the like used in commercial products) are added to an oil of lubricating viscosity. In one embodiment, all three detergents are added. Preferably the detergent is a salicylate detergent, more preferably a calcium salicylate detergent. In another embodiment, approximately 3%-30 weight % of hydrocarbyl aromatic fluid, provides the beneficial synergistic characteristics outlined above. More preferably we believe that about 0.25%-2% of low TBN calcium salicylate, about 0.25%-2% of medium TBN calcium salicylate and about 0.25%-2% of high TBN calcium salicylate on an active ingredient basis, when used with approximately 3%-30% of hydrocarbyl aromatic fluid, will provide the desirable characteristics summarized above.

The hydrocarbyl aromatics that can be used can be any hydrocarbyl molecule that contains preferably at least 5% of its weight derived from an aromatic moiety such as a benzenoid moiety or naphthenoid moiety, or their derivatives. This can include hydrocarbyl aromatics such as alkyl benzenes, alkyl naphthalenes, alkyl diphenyl oxides, alkyl naphthols, alkyl diphenyl sulfides, alkylated bis-phenol A, and the like. The aromatic can be mono-alkylated, dialkylated, polyalkylated, and the like. Functionalization can thus be as mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. Typically, the hydrocarbyl groups can range from $C_6$ up to about $C_{60}$ with a range of about $C_8$ to about $C_{40}$ often being preferred. A mixture of hydrocarbyl groups is often preferred to the use of a single hydrocarbyl group. The hydrocarbyl group can be alkyl as described above, and the hydrocarbyl group can optionally contain sulfur, oxygen, and/or nitrogen containing substituents. Viscosities at 100° C. of approximately 3 cSt to about 50 cSt are often desirable, with viscosities of approximately 3.4 cSt to about 20 cSt often being preferred. Such viscosities can be determined by ASTM Test Method 445.

Alkylated aromatics such as the hydrocarbyl aromatics of the present invention may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

This synergistic mixture of the detergent components in combination with hydrocarbyl aromatic of this invention can be used at a total concentration of about 5% to about 45% in a paraffinic lubricating oil base stock or a mixture of lubricating oil base stocks having a combined viscosity index of approximately 110 or greater or more preferably 115 or greater. Concentrations of such synergistic components can more preferably range from approximately 5% to about 30%, or more preferably from about 6% to about 25% by weight. Group II and/or Group III hydroprocessed or hydrocracked base stocks, wax isomerate base stock, or their synthetic counterparts such as polyalphaolefin lubricating oils can often be preferred as lubricating base stocks when used in conjunction with the components of this invention. At least about 20% of the total composition should consist of such Group II base stock, Group III base stock or wax isomerate base stock, with at least about 30%, on occasion being more preferable, and at least about 80% on occasion being even more preferable. In one embodiment, gas to liquid base stocks are preferentially used with the components of this invention as a portion or all of the base stocks used to formulate the finished lubricant. A mixture of all or some of such base stocks can be used to advantage and can often be preferred. We believe that the improvement and benefit is best when the components of this invention are added to lubricating systems comprised of primarily Group II, base stock or Group III base stocks derived from hydrotreating, hydrocracking, hydroisomerization, and/or wax isomerate base stock derived from gas to liquid processes with up to lesser quantities of alternate fluids.

As discussed above, we believe that the improvement and benefit is optimized when the components of this invention are added to lubricating systems comprised of primarily Group II base stock, Group III base stock, or wax isomerate base stock with up to lesser quantities of co-base stocks. These co-base stocks include polyalphaolefin oligomeric low and medium and high viscosity oils, dibasic acid esters, polyol esters, other hydrocarbon oils, supplementary hydrocarbyl aromatics and the like. These co-base stocks can also include some quantity of decene-derived trimers and tetramers, and also some quantity of Group I base stocks, provided that the above Group II base stock, Group III type base stock, and wax isomerate base stock predominate and make up at least about 50% of the total base stocks contained in fluids comprised of the elements of the above invention.

A wide range of lubricating oils is known in the art. Lubricating oils that are useful in the present invention are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve the at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories of base oil stocks developed and defined by the American Petroleum Institute (API Publication 1509; www.API.org) to create guidelines for lubricant base oils. Group I base stock generally have a viscosity index of between about 80 to 120 and contains greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contain less than or equal to about 0.03% sulfur and greater than about 90% saturates. Group IV includes polyalphaolefins (POA). Group V base stock includes base stocks not included in Groups I-IV. Table 1 summarizes properties of each of these five groups.

TABLE 1

Base Stock Properties

| | Saturates | Sulfur | Viscosity Index |
|---|---|---|---|
| Group I | <90 &/or | >0.03% & | ≧80 & <120 |
| Group II | ≧90 & | ≦0.03% & | ≧80 & <120 |
| Group III | ≧90 & | ≦0.03% & | ≧120 |
| Group IV | Polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (polybutylenes, poly-propylenes, propylene isobutylene copolymers, ethylene-olefin copolymers, and ethylene-alphaolefin copolymers, for example). Polyalphaolefin (PAO) oil base stocks are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are incorporated herein by reference in their entirety.

The number average molecular weights of the PAOs, which are known materials and generally available on a major commercial scale from suppliers such as ExxonMobil Chemical Company, Chevron-Phillips, BP-Amoco, and others, typically vary from about 250 to about 3,000, although PAO's may be made in viscosities up to about 100 cSt (100° C.). The PAOs are typically comprised of relatively low molecular weight hydrogenated polymers or oligomers of alphaolefins which include, but are not limited to, about $C_2$ to about $C_{32}$ alphaolefins with the about $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of about $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of about 1.5 to 12 cSt.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. All of the aforementioned patents are incorporated herein by reference in their entirety. The dimers of the $C_{14}$ to $C_{18}$ olefins are described in U.S. Pat. No. 4,218,330, also incorporated herein.

Other useful synthetic lubricating base stocks oils may also be utilized, for example those described in the seminal work "Synthetic Lubricants", Gunderson and Hart, Reinhold Publ. Corp., New York 1962, which is incorporated in its entirety.

In alkylated aromatic stocks, the alkyl substituents are typically alkyl groups of about 8 to 25 carbon atoms, usually from about 10 to 18 carbon atoms and up to about three such substituents may be present, as described for the alkyl benzenes in ACS Petroleum Chemistry Preprint 1053-1058, "Poly n-Alkylbenzene Compounds: A Class of Thermally Stable and Wide Liquid Range Fluids", Eapen et al, Phila. 1984. Tri-alkyl benzenes may be produced by the cyclodimerization of 1-alkynes of 8 to 12 carbon atoms as described in U.S. Pat. No. 5,055,626. Other alkylbenzenes are described in European Patent Application No. 168 534 and U.S. Pat. No. 4,658,072. Alkylbenzenes are used as lubricant basestocks, especially for low-temperature applications (arctic vehicle service and refrigeration oils) and in papermaking oils. They are commercially available from producers of linear alkylbenzenes (LABs) such as Vista Chem. Co, Huntsman Chemical Co., Chevron Chemical Co., and Nippon Oil Co. The linear alkylbenzenes typically have good low pour points and low temperature viscosities and VI values greater than about 100 together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, N.Y. 1993. Each of the aforementioned references is incorporated herein by reference in its entirety.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosure of which is incorporated herein by reference in their entirety. Gas-to-Liquids (GTL) base oils, Fischer-Tropsch wax derived base oils, and other wax-derived hydroisomerized (wax isomerate) base oils be advantageously used in the instant invention, and may have useful kinematic viscosities at 100° C. of about 3 cSt to about 50 cSt, preferably about 3 cSt to about 30 cSt, more preferably about 3.5 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

Gas-to-Liquids (GTL) base oils, Fischer-Tropsch wax derived base oils, have a beneficial kinematic viscosity advantage over conventional Group II and Group III base oils, which may be very advantageously used with the instant invention. Gas-to-Liquids (GTL) base oils can have significantly higher kinematic viscosities, up to about 20-50 cSt at 100° C., whereas by comparison commercial Group II base oils can have kinematic viscosities, up to about 15 cSt at 100° C., and commercial Group III base oils can have kinematic viscosities, up to about 10 cSt at 100° C. The higher kinematic viscosity range of Gas-to-Liquids (GTL) base oils, compared to the more limited kinematic viscosity range of Group II and Group III base oils, in combination with the instant invention can provide additional beneficial advantages in formulating lubricant compositions. Also, the exceptionally low sulfur content of Gas-to-Liquids (GTL) base oils, and other wax-derived hydroisomerized base oils, in combination with the low sulfur content of suitable olefin oligomers and/or alkyl aromatics base oils, and in combination with the instant invention can provide additional advantages in lubricant compositions where very low overall sulfur content can beneficially impact lubricant performance.

Alkylene oxide polymers and interpolymers and their derivatives containing modified terminal hydroxyl groups obtained by, for example, esterification or etherification are useful synthetic lubricating oils. By way of example, these oils may be obtained by polymerization of ethylene oxide or propylene oxide, the alkyl and aryl ethers of these polyoxyalkylene polymers (methyl-polyisopropylene glycol ether having an average molecular weight of about 1000, diphenyl ether of polyethylene glycol having a molecular weight of about 500-1000, and the diethyl ether of polypropylene glycol having a molecular weight of about 1000 to 1500, for example) or mono- and polycarboxylic esters thereof (the acidic acid esters, mixed $C_{3-8}$ fatty acid esters, or the $C_{13}$Oxo acid diester of tetraethylene glycol, for example).

Esters comprise a useful base stock. Additive solvency and seal compatibility characteristics may be secured by the use of esters such as the esters of dibasic acids with monoalkanols and the polyol esters of mono-carboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols (preferably the hindered polyols such as the neopentyl polyols e.g. neopentyl glycol, trimethylol ethane, 2-methyl-2-propyl-1,3-propanediol, trimethylol propane, pentaerythritol and dipentaerythritol) with alkanoic acids containing at least about 4 carbon atoms (preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid).

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. Such esters are widely available commercially, for example, the Mobil P-41 and P-51 esters (Mobil Chemical Company).

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl)silicate, tetra-(p-tert-butylphenyl)silicate, hexyl-(4-methyl-2-pentoxy)disiloxane, poly(methyl) siloxanes, and poly-(methyl-2-mehtylphenyl)siloxanes.

Another class of synthetic lubricating oil is esters of phosphorous-containing acids. These include, for example, tricresyl phosphate, trioctyl phosphate, diethyl ester of decane-phosphonic acid.

Another class of oils includes polymeric tetrahydrofurans and the like.

Besides unique additive effects of hydrocarbyl aromatics and high molecular weight olefin oligomers of this invention, we believe that highly refined, low sulfur Group II/III base oils (such as hydroprocessed oils, HDP, gas to liquids base stocks) may be used in place or in addition to Group IV and V base oils as the base stocks used in combination with the components of this invention to provide the above-documented superior performance characteristics. Polyalphaolefin oils that can be used include trimers and tetramers of decene-1 having a viscosity of approximately 4 cSt at 100° C. Paraffinic oils that can be used include hydrotreated oils having a viscosity of approximately 4.5 cSt at 100° C., and approximately 22.1 cSt at 40° C. Higher and lower viscosity fluids, having higher and lower viscosity indices, can often be preferred.

Other Lubricating Oil Components

The instant invention can be used with additional lubricant components in effective amounts in lubricant compositions, such as for example polar and/or non-polar lubricant base oils, and performance additives such as for example, but not limited to, oxidation inhibitors, metallic and non-metallic dispersants, metallic and non-metallic detergents, corrosion and rust inhibitors, metal deactivators, anti-wear agents (metallic and non-metallic, phosphorus-containing and non-phosphorus, sulfur-containing and non-sulfur types), extreme pressure additives (metallic and non-metallic, phosphorus-containing and non-phosphorus, sulfur-containing and non-sulfur types), anti-seizure agents, pour point depressants, wax modifiers, viscosity modifiers, seal compatibility agents, friction modifiers, lubricity agents, anti-staining agents, chromophoric agents, defoamants, demulsifiers, and others.

For a review of many commonly used additives see Klamann in Lubricants and Related Products, Verlag Chemie, Deerfield Beach, Fla.; ISBN 0-89573-177-0, which gives a good discussion of a number of the lubricant additives discussed mentioned below. Reference is also made "Lubricant Additives" by M. W. Ranney, published by Noyes Data Corporation of Parkridge, N.J. (1973).

Additional Detergents

The present invention may be used in combination with other detergents. Suitable detergents include the alkali or alkaline earth metal salts of sulfates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Ranney in "Lubricant Additives" op cit discloses a number of overbased metal salts of various sulfonic acids that are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates which are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably $C_4$-$C_{20}$. Examples of suitable phenols include isobutylphenol, 2-ethylhexylphenol, nonylphenol, 1-ethyldecylphenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids other than salicylic acid may also be used as detergents. These carboxylic acid detergents are prepared by a method analogous to that used for salicylates.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039, for example, which is incorporated herein by reference in its entirety. Typically, the total detergent concentration is about 0.01 to about 6.0 weight percent, preferably, 0.1 to 0.4 weight percent.

Anitwear and EP Additives

Internal combustion engine lubricating oils require the presence of antiwear and/or extreme pressure (EP) additives in order to provide adequate antiwear protection for the engine. Increasingly specifications for engine oil performance have exhibited a trend for improved antiwear properties of the oil. Antiwear and EP additives perform this role by reducing friction and wear of metal parts.

While there are many different types of antiwear additives, for several decades the principal antiwear additive for internal combustion engine crankcase oils has been a metal alkylthiophosphate and more particularly a metal dialkyl-dithiophosphate in which the primary metal constituent is zinc, or zinc dialkyl-dithiophosphate (ZDDP). ZDDP compounds are generally of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched and may be derived from primary and/or secondary alcohols and/or alkaryl groups such as alkyl phenols. The ZDDP is typically used in amounts of from about 0.4 to 1.4 weight percent of the total lube oil composition, although more or less can often be used advantageously.

However, it has been found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives have also been used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably about 3 to 20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorous acids and thiophosphorous acid esters as lubricant additives is disclosed in U.S. Pat. Nos. 2,443,264; 2,471,115; 2,526,497; and 2,591,577. Addition of phosphorothionyl disulfides as antiwear, antioxidant, and EP additives is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex ($R{=}C_8$-$C_{18}$ alkyl) are also useful antiwear agents. Each of the aforementioned patents is incorporated by reference herein in its entirety.

Esters of glycerol may be used as antiwear agents. For example, mono-, di, and tri-oleates, mono-palmitates and mono-myristates may be used.

ZDDP has been combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties. The aforementioned patents are incorporated herein by reference in their entirety.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics (including dimercaptothiadiazoles, mercaptobenzothiazoles, triazines and the like), alicyclics, amines, alcohols, esters, diols, triols, fatty amides and the like can also be used. Such additives may be used in an amount of about 0.01 to 6 weight percent, preferably about 0.01 to 4 weight percent.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,00, and even more typically between about 50,000 and 200,000.

Examples of suitable viscosity index improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of about 50,000 to 200,000 molecular weight.

Viscosity index improvers may be used in an amount of about 0.01 to 6 weight percent, preferably about 0.01 to 4 weight percent.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197 for example, the disclosures of which are incorporated by reference herein in their entirety.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics that are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho coupled phenols include: 2,2'-bis(6-t-butyl-4-heptyl phenol); 2,2'-bis(6-t-butyl-4-octyl phenol); and 2,2'-bis(6-t-butyl-4-dodecyl phenol). Para coupled bis phenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as the aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups win not contain more than about 14 carbon atoms. The general types of amine antioxidants useful in the present compositions include diphenylamines, phenyl naphthyl-amines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants. Low sulfur peroxide decomposers are useful as antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, axylamines, low sulfur peroxide decomposers and other related components. These antioxidants may be used individually by type or in combination with one another. Such additives may be used in an amount of about 0.01 to 5 weight percent, preferably about 0.01 to 1.5 weight percent.

Dispersant

During engine operation, oil insoluble oxidation byproducts are produced. Dispersants help keep these byproducts in solution, thus diminishing their deposit on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorous. Typical hydrocarbon chains contain about 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. Patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose. Each of the aforementioned patents is incorporated herein in its entirety by reference.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044, which are incorporated herein in their entirety by reference.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythiritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305, incorporated herein by reference.

The molecular weight of the alkenyl succinic anhydrides used in the preceding paragraphs will range between about 800 and 2,500 or more. The hydrocarbyl groups may be, for example, a group such as polyisobutylene having a molecular weight of about 500 to 5000 or a mixture of such groups. The above products can be post-reacted with various reagents such as sulfur, oxygen, formaldehyde, carboxylic acids such as oleic acid, hydrocarbyl dibasic acids or anhydrides, and boron compounds such as borate esters or highly borated dispersants. The dispersants can be borated with from about 0.1 to about 5 moles of boron per mole of dispersant reaction product, including those derived from mono-succinimide, bis-succinimide (also known as disuccinimides), and mixtures thereof.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039, which are incorporated herein in their entirety by reference.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average of about 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloro alkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (such as paraformaldehyde and formalin), acetaldehyde and aldol (b-hydroxybutyraldehyde, for example). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197, which are incorporated herein in their entirety by reference.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine coupled Mannich adducts, their capped derivatives, and other related components. Such additives may be used in an amount of about 0.1 to 20 weight percent, preferably about 0.1 to 8 weight percent.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Each of these references is incorporated herein in its entirety. Such additives may be used in an amount of about 0.01 to 5 weight percent, preferably about 0.01 to 1.5 weight percent.

Corrosion Inhibitors

Corrosion inhibitors are used to reduce the degradation of metallic parts that are in contact with the lubricating oil composition. Suitable corrosion inhibitors include thiadiazoles and triazoles. See, for example, U.S. Pat. Nos. 2,719,125; 2,719,126; and 3,087,932, which are incorporated herein by reference in their entirety. Such additives may be used in an amount of about 0.01 to 5 weight percent, preferably about 0.01 to 1.5 weight percent.

Seal Compatibility Additives

Seal compatibility agents help to swell elastomeric seals by causing a chemical reaction in the fluid or a physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Additives of this type are commercially available. Such additives may be used in an amount of about 0.01 to 3 weight percent, preferably about 0.01 to 2 weight percent.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers. Usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to also in Klamann in Lubricants and Related Products, op cite.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of any lubricant or fluid containing such material(s). Friction modifiers, also known as friction reducers, or lubricity agents or oiliness agents, and other such agents that change the coefficient of friction of lubricant base oils, formulated lubricant compositions, or functional fluids, may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc.

Ashless friction modifiers may have also include lubricant materials that contain effective amounts of polar groups, for example hydroxyl-containing hydrocaryl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifiers(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in the table below.

Note that many of the additives are shipped from the manufacturer and used with a certain amount of processing oil solvent in the formulation. Accordingly, the weight amounts in the Table 2, as well as other amounts mentioned in this patent, are directed to the amount of active ingredient (that is the non-solvent or non-diluent oil portion of the ingredient). The weight percents indicated below are based on the total weight of the lubricating oil composition.

TABLE 2

Typical Amounts of Various Lubricant Components

| Compound | Approximate Weight Percent (Useful) | Approximate Weight Percent (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, preferably 0.01-15 |
| Antioxidant | 0.01-5 | 0.01-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

EXAMPLES

The types and quantities of performance additives used in combination with the instant invention in lubricant compositions are not limited by the examples shown herein as illustrations.

Unless otherwise specified, kinematic viscosity at 40° C. or 100° C. was determined according to ASTM test method D 445, viscosity index was determined by ASTM test method D 2270, pour point was determined by ASTM test method D 97, and TBN by ASTM test method number D 2896.

The hydrocarbyl aromatic used in the examples below was alkylated naphthalene (primarily mono-alkylated) having a viscosity of approximately 4.6 cSt at 100° C. The primarily monoalkylated naphthalene was prepared by the monoalkylation of naphthalene with an olefin primarily comprised of 1-hexadecene.

Typical properties of the base oils used in this invention are shown in the table below.

TABLE 3

Typical Base Stock Properties

| | | HDT 4 | Hydrocarbyl Aromatic | PAO 4 | GpIII 4 |
|---|---|---|---|---|---|
| D 445 | Kinematic Viscosity at 40° C., cSt | 22.65 | 29.3 | 18 | 15.6 |
| D 445 | Kinematic Viscosity at 100° C., cSt | 4.55 | 4.7 | 4 | 3.8 |
| D2272 | Viscosity Index | 116 | 75 | 120 | 138 |
| D1500 | ASTM Color | L0.5 | 1.0 | 0 | 0 |
| D2007 | Saturates, wt % | 97 | na | 100 | na |
| D2622 | Sulfur, ppm | 60 | 150 | 0 | 0 |
| | API Group/Base Oil Classification | II | V | IV | III |

HDT 4 is a hydrotreated base stock, PAO 4 is a polyolefin base stock, and GpIII 4 is a Group III base stock.

The three metallic detergents used below to exemplify some of the aspects of the invention were:

A. The low TBN calcium salicylate used was made by the neutralization with calcium base of alkylated salicylic acid and provided as a concentrate in process oil included as a manufacturing and handling aid. This calcium salicylate detergent had a total base number of approximately 60 and a calcium content of approximately 2.3%.

B. The medium TBN calcium salicylate used was made by the neutralization with calcium base of alkylated salicylic acid and provided as a concentrate in process oil included as a manufacturing and handling aid. This calcium salicylate detergent had a total base number of approximately 160 and a calcium content of approximately 6%.

C. The high TBN calcium salicylate used was made by the neutralization with calcium base of alkylated salicylic acid and provided as a concentrate in process oil included as a manufacturing and handling aid. This calcium salicylate detergent had a total base number of approximately 270 and a calcium content of approximately 10%.

Friction Reduction Results Tests

High Frequency Reciprocating Rig (HFFR) testing (see Tribology Transaction Vol 44 (2001), 4, 626-636) was used to measure boundary friction of the lubricant compositions described herein, expressed as coefficient of friction. The reference (baseline) lubricant composition was a reference base oil which was a mixture of polyalphaolefin oil (PAO) and hydrocarbyl aromatic (alkylated naphthalene comprised primarily of $C_{16}$ alkylated naphthalene). The frictional response of the reference base oil (baseline) and of the various detergent/base oil mixtures (examples) was measured over a range of temperatures with the data plotted as a function of coefficient of friction versus temperature. The friction reducing effect of various individual detergents (the calcium salicylates as described in detail above) at low concentrations (up to about 3%) in the reference base oil were tested. Then, the friction reducing effect of a combination or mixture of differing salicylates in the reference base oil was measured. The expected friction reduction of the detergent combinations was calculated as a weighted average of the friction contributions of the individual components relative to the reference base oil. The data clearly show the unexpected favorable reduction in friction when the fluids tested contained mixed high and low TBN calcium salicylates (i.e., in dumbbell blends).

Example 1

Coefficient of Friction Data for a Lubricant Mixture Containing High, Medium, and Low TBN Salicylates (FIG. 1)

The data in FIG. 1 show that the base fluid mixture without detergents demonstrate a relatively high coefficient of friction averaging about 0.2 over the temperature range studied. The addition of the medium TBN overbased detergent (at 1 wt %) lowered the coefficient of friction somewhat, with greater reductions in the coefficient of friction using the low TBN calcium salicylate (at 1 wt %), and greater yet reductions in the coefficients of friction using the high TBN calcium salicylate (at 2.4 st %).

FIG. 1 shows the coefficient of friction data for a lubricant mixture containing the high, medium and low TBN salicylate (2.4/1/1; total 4.4%). When the measured coefficient of friction for the mixed TBN salicylate detergents was compared to the predicted coefficient of friction data for this mixture, the actual mixture of the three salicylates provided a significantly lower coefficient of friction than that predicted. Thus, the mixed low, medium, and high TBN detergents exhibit better friction reducing performance than that calculated (expected), due to any unexpected synergy among the component detergents.

One of ordinary skill in the art would recognize that it is valid to compare the admixture of TBN detergents at a higher concentration to the individual high, medium and low TBN detergents concentrations because each individual detergent concentration is above its saturation point for occupying metal coordination sites and thus lowering the coefficient of friction. Likewise it is valid to compare the coefficient of friction for the admixed TBN detergents to the weighted mean of the individual components' coefficients of friction as in the admixed examples it is the ratio of the various detergents competing for the metal coordination sites that determine the coefficient of friction, not the absolute concentration of those individual detergents. That is, once an individual detergent is supplied to the experiment at greater than its saturate concentration for the coefficient of friction, the factor determining the coefficient of friction is the ratio of the competing individual detergents.

Example 2

Figure 2:
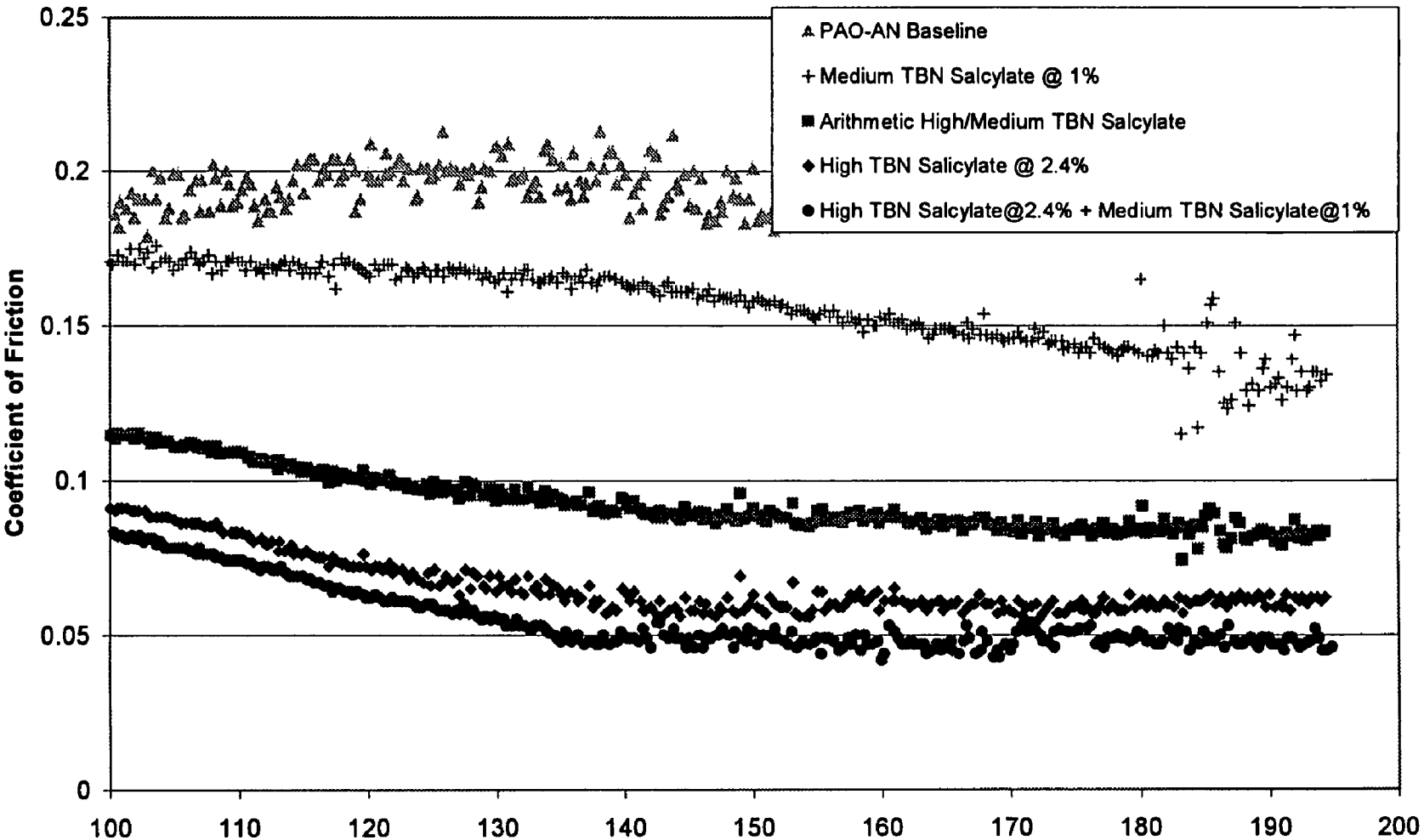
FIG. 2 is a graphical representation of coefficient of friction data for a lubricant mixture containing high and medium TBN salicylates.

Coefficient of Friction Data for a Lubricant Mixture Containing High, Medium, and Low TBN Salicylates (FIG. 2)

In FIG. 2, the mixture of the medium and high TBN detergents (1/2.4 ratio; 3.4 wt %) was compared to the individual (not mixed) medium TBN calcium salicylate (1 wt %) and the high TBN calcium salicylate (2.4 wt %) in reference oil. The coefficient of friction for the mixed medium/high TBN detergents in reference oil was found to be unexpectedly reduced to a surprisingly low value of less than about 0.06. This reduction in the coefficient of friction was unexpected when compared to the calculated coefficient of friction for the two-component mixture. In particular, this mixed medium and high TBN detergent combination gives lower coefficient of friction that of either of the individual detergents alone. Thus, the mixed detergents exhibit lower coefficient of friction than the expected (calculated) value, as well as lower coefficients of friction than either of the two detergents measured individually in the absence of synergism.

Example 3

Figure 3:
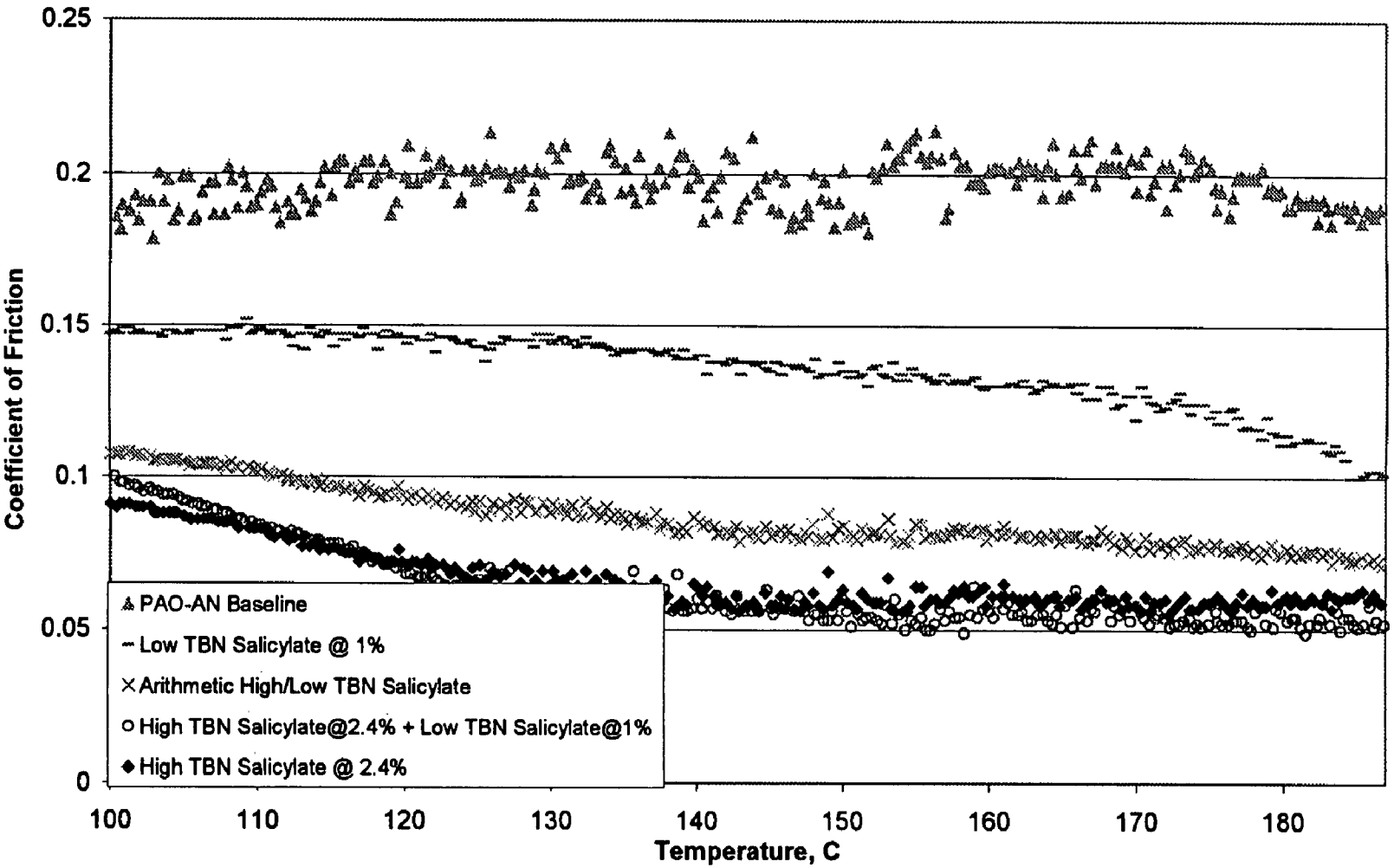
FIG. 3 is a graphical representation of coefficient of friction data for a lubricant mixture containing high and low TBN salicylates.

Coefficient of Friction Data for a Lubricant Mixture Containing High and Low TBN Salicylates (FIG. 3)

In FIG. 3, the mixture of the low and high TBN overbased detergents were tested and the measured coefficients of friction were found to be unexpectedly reduced to a surprisingly low value of about 0.05. This reduction is unexpected when compared to the predicted (calculated) coefficients of friction for the mixture. In particular, the coefficients of friction measured for the individual (not mixed) low TBN calcium salicylate and the high TBN calcium salicylate were found to be not as low as that of the actual mixture of low and high TBN detergents described above. Thus, the mixed low and high TBN detergents exhibit better performance than either of the two ingredients taken separately, and better than that calculated (expected) for the mixture of the components absent a showing of synergism.

Improved Film-Forming Test Results

High Frequency Reciprocating Rig (HFRR) testing was performed using a mixture of polyalphaolefin oil to which hydrocarbyl aromatic (alkylated naphthalene comprised primarily of $C_{16}$ alkylated naphthalene) was incorporated. The film-forming response was measured over a range of temperatures with the data plotted as a function of percent film formation versus temperature. Various detergents (the calcium salicylates as described in detail above) were then added individually, and in mixtures of differing salicylates to the mixed base fluid containing a relatively small amount of hydrocarbyl aromatic and the film-forming test was rerun to determine the effect of such additions. The data clearly show the unexpected favorable improvement in film-forming tendencies when the fluids tested contained mixed high and low TBN calcium salicylates.

Example 4-6

Figure 4:
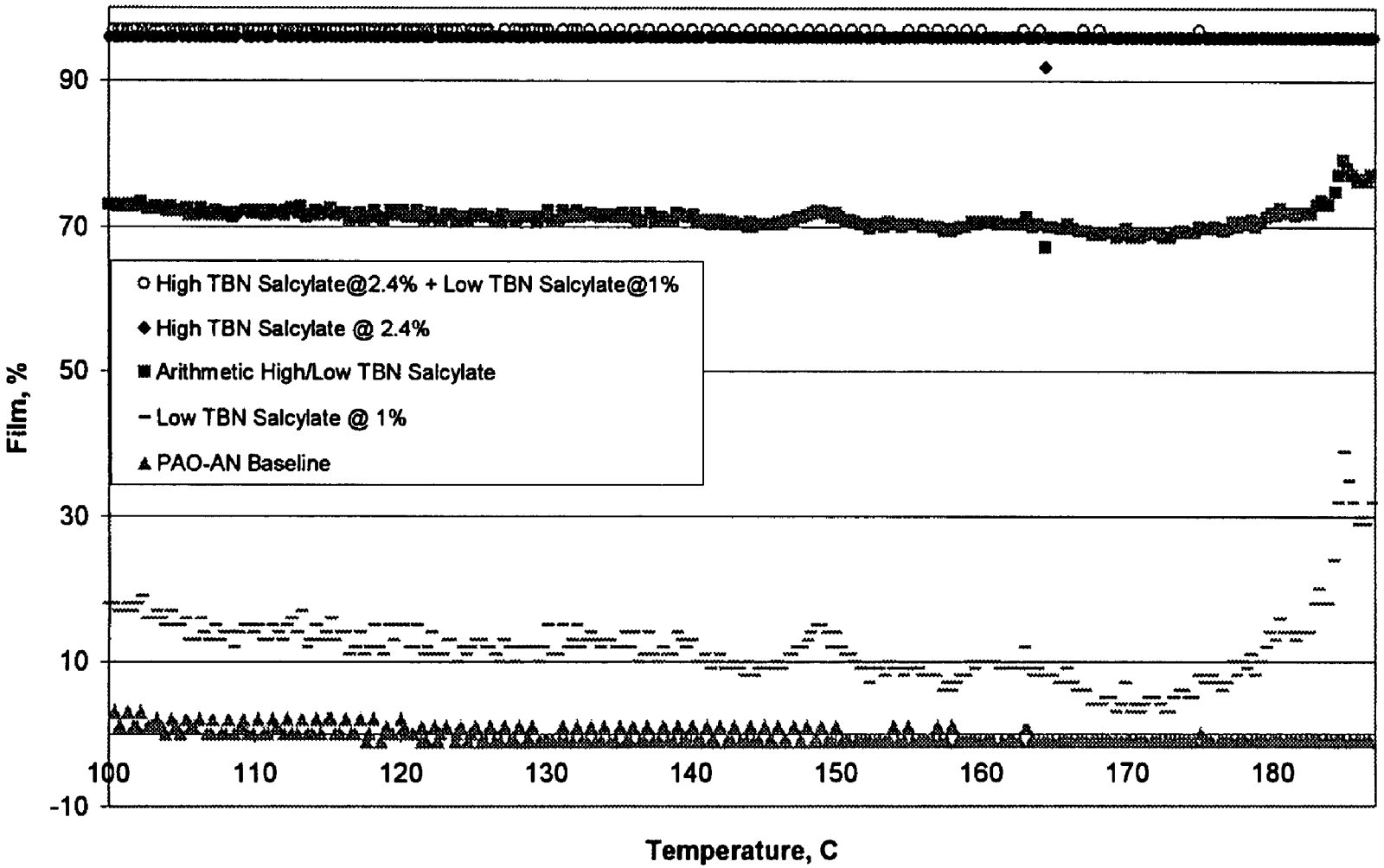
FIG. 4 is a graphical representation of film forming data for a lubricant mixture containing high and low TBN salicylates.
Figure 5:
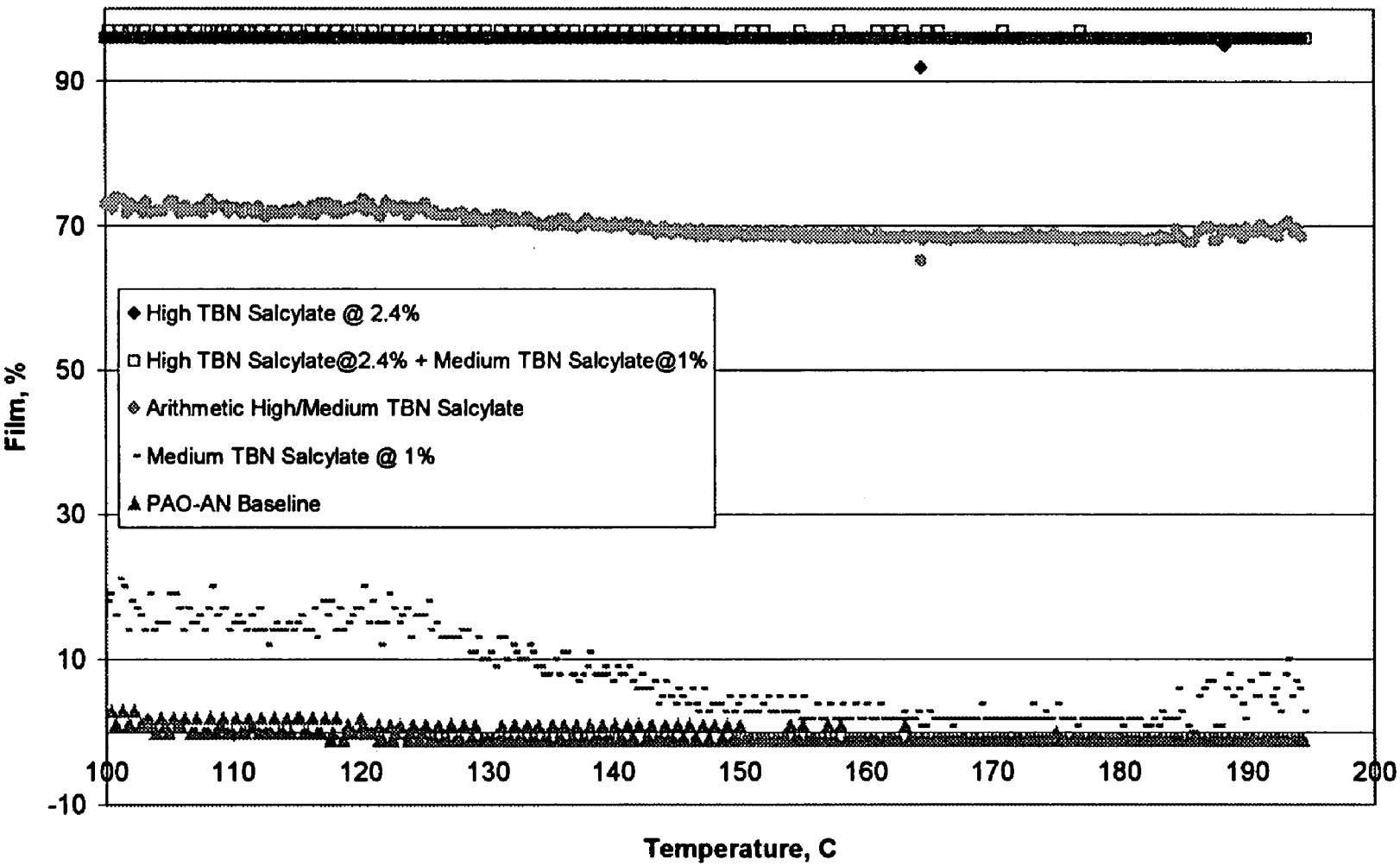
FIG. 5 is a graphical representation of film forming data for a lubricant mixture containing high and medium TBN salicylates.
Figure 6:
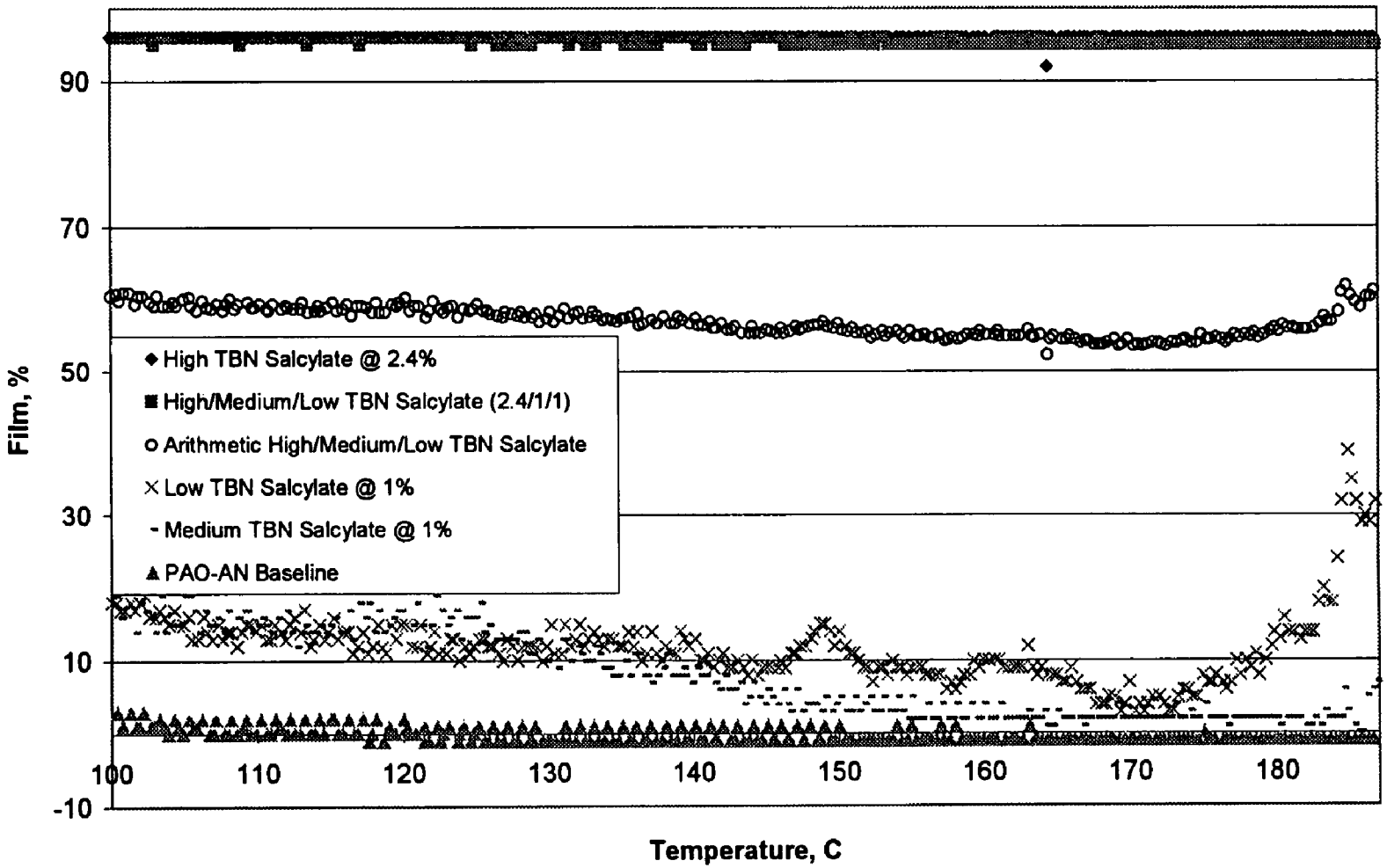
FIG. 6 is a graphical representation of film forming data for a lubricant mixture containing high, medium and low TBN salicylates.

Film Forming Data for a Lubricant Mixture Containing Mixed TBN Salicylates (FIG. 4-6)

The film forming tendencies of the measured low and high TBN salicylates (and a mixture of the two detergents) are shown in FIG. 4. The results for the mixtures are significantly better than that (expected) calculated for the two mixed detergents.

The film forming tendencies of the measured medium and high TBN salicylates (and a mixture of the two detergents) are shown in FIG. 5. The results for the mixtures are significantly better than that (expected) calculated for the two mixed detergents.

The film forming tendencies of the measured low, medium, and high TBN salicylates (and a mixture of three detergents) are shown in FIG. 6 and are significantly better than that (expected) calculated for the three mixed detergents.

Example 7

Figure 7:
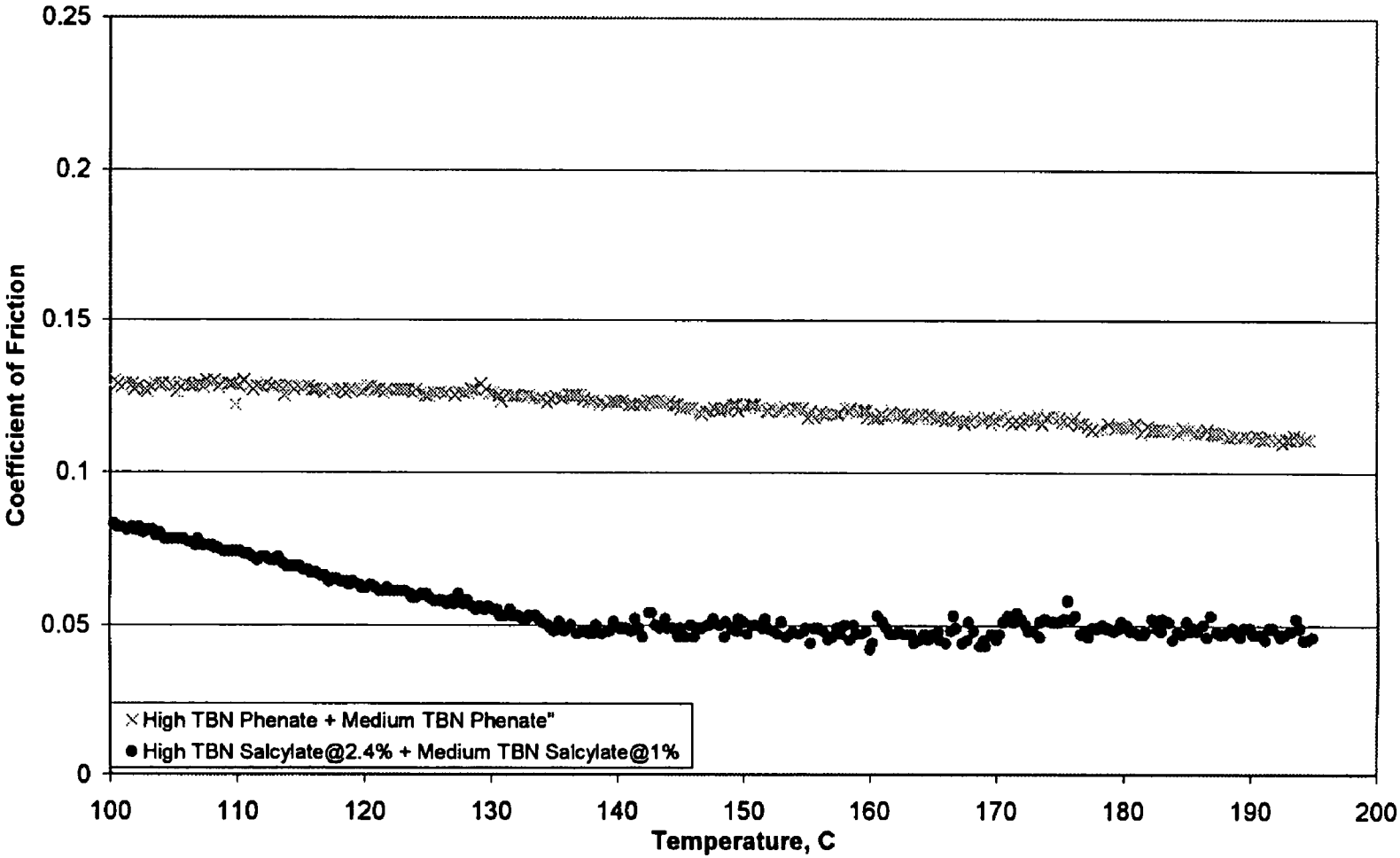
FIG. 7 is a graphical comparison of coefficient of friction data for a lubricant mixture containing a mixed detergent comprising high and medium TBN calcium salicylate detergents with those of analogous mixtures containing a mixed detergent comprising high and medium TBN calcium phenate detergents.

Comparison of Coefficient of Friction Data for Mixed TBN Salicylate and Mixed TBN Phenate Detergents (FIG. 7)

The High Frequency Reciprocating Rig was used to determine whether the unexpected friction reduction results found for high and medium TBN calcium salicylate detergents would also be found for other analogous compositions using non-salicylate detergents. As shown in FIG. 7, the frictional properties of a mixture of high and medium TBN calcium phenates were measured and compared to the frictional properties of high and medium TBN salicylates. The frictional properties of the high and medium TBN salicylates were found to be much lower than for the mixed phenate system.

Example 8

Figure 8:
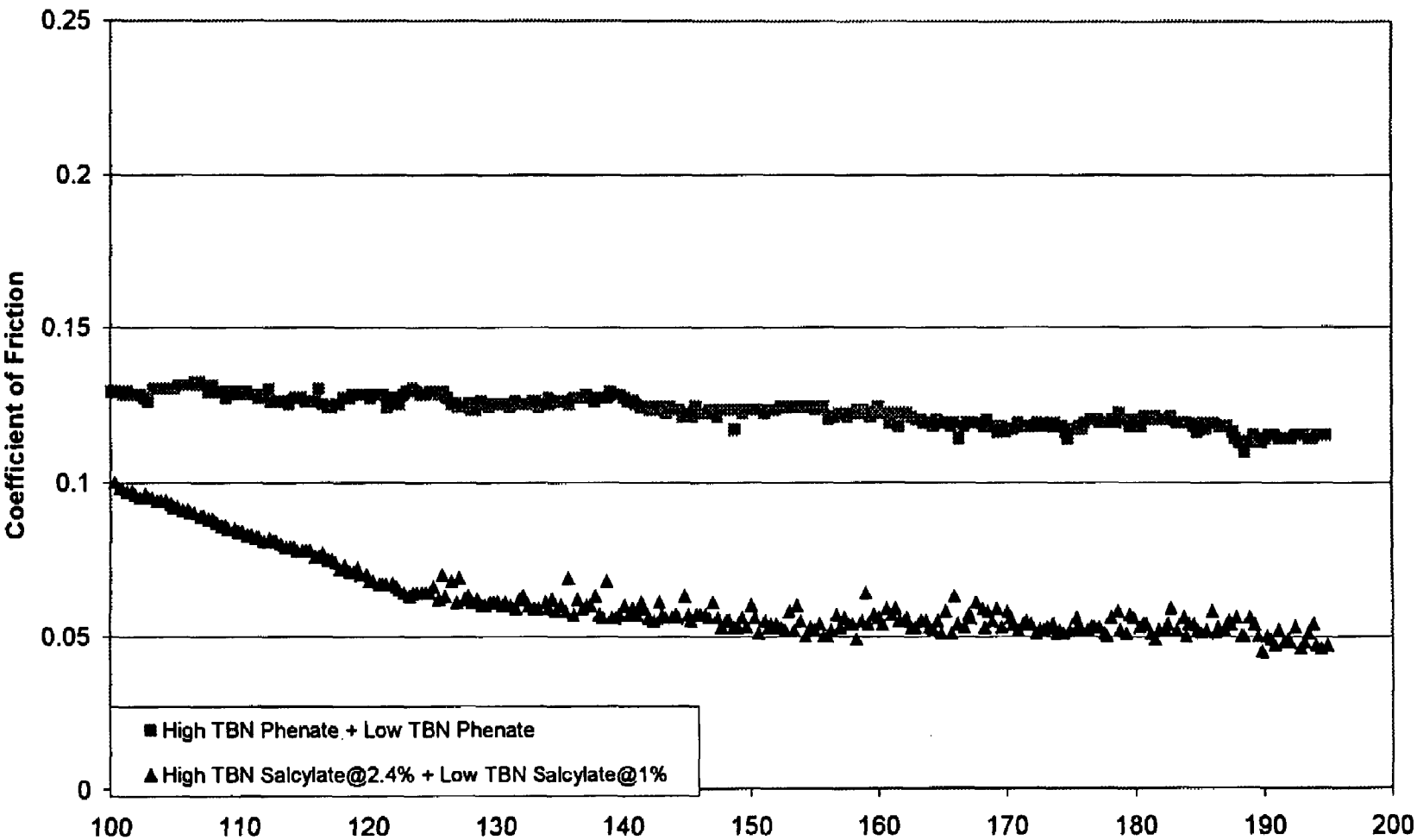
FIG. 8 is a graphical comparison of coefficient of friction data for a lubricant mixture containing a mixed detergent comprising high and low TBN calcium salicylate detergents with those of analogous mixtures containing a mixed detergent comprising high and low TBN calcium phenate detergents.

Comparison of Coefficient of Friction Data for Mixed TBN Calcium Salicylate Detergents with Mixed TBN Calcium Phenate Detergents (FIG. 8)

The High Frequency Reciprocating Rig was used to determine whether the unexpected friction reduction results found for high and low TBN calcium salicylate detergents would also be found for analogous compositions using high and low TBN calcium phenates. As shown in FIG. 8, the frictional properties of a mixture of high and low TBN calcium phenates were measured and compared to the frictional properties of high and low TBN salicylates. The frictional properties of the high and low TBN salicylates were found to be much lower than for the mixed phenate system.

Example 9

Improved Cleanliness and Ring Sticking

The cleanliness and ring sticking properties of oils containing various combinations of detergents were measured with the VW TDI 2 test (TDI2 test (CEC L-78-T-99; VW PV 1452)) and are compared in Table 4. Two separate pairs of engine tests were performed to determine the effect of using: A) a mixture of low TBN calcium salicylate and a high TBN calcium salicylate versus B) a mixture of a low TBN calcium salicylate, a medium TBN calcium salicylate, and a high TBN overbased calcium salicylate, with the total detergent concentrations of A) and B) being held to an equal and identical total detergent concentration of 4.4 wt % to compare the three detergent ingredients of B) above to an equal total concentration of the two detergent ingredients of A) above. Detergent mixture A above was meant to exemplify the use of a two detergent system, similar to that disclosed in Japanese Patent Application No. 10-53784. Detergent mixture B was intended to exemplify the three-component detergent mixture of this invention. The remainder of the components in A and B were similar, with all of the formulations containing alkylated naphthalene, which is believed to also be a key ingredient for one aspect of this invention (whether a three-component or a two-component detergent mixture is used in conjunction with the hydrocarbyl aromatic).

The results of Table 4 clearly show unexpected and clearly significant improvements in cleanliness for each of the three-ingredient low, medium, and high TBN detergent systems (examples 4.2 and 4.4) when compared to the identical total detergent concentration of the two-ingredient low and high TBN detergent system (examples 4.1 and 4.3). These results clearly show unexpected improvement over the disclosures of Japanese Patent Application No. 10-53784. Two pairs of side-by side engine tests confirm the unexpected piston cleanliness and ring sticking results when the mixed three-detergent system of low, medium, and high TBN detergent system is compared directly with the two-way mixed detergent system of low and high TBN calcium salicylate detergent system.

Ring sticking is a performance parameter that measures the freedom of movement of a piston compression ring on a piston. It is desirable that the compression ring should be able to move freely. Ring sticking and piston merits are compared on an equivalent reference basis. The improvement of B versus A is the improvement of B over reference versus A over reference. Piston merit is a performance parameter that measures the overall cleanliness of a piston. Piston merit is measured on a merit scale, so larger ratings are more desirable than lower ratings. Kinematic viscosity (KV) at 100° C. and cold cranking simulator (CCS) viscosity are used to classify the viscosity grade of an engine oil per SAE J300.

TABLE 4

Comparison of Detergent Systems Containing Two and Three Salicylate Detergents*

| | Example: | | | |
|---|---|---|---|---|
| | 4.1 Detergent System A | 4.2 Detergent System B | 4.3 Detergent System A | 4.4 Detergent System B |
| Low TBN Salicylate | 1 | 1 | 1 | 1 |
| High TBN Salicylate | 3.4 | 2.4 | 3.4 | 2.4 |
| Medium TBN Salicylate | 0 | 1 | 0 | 1 |
| VI Improver | 3.5 | 4.6 | 0.4 | 0.9 |

TABLE 4-continued

Comparison of Detergent Systems Containing Two and Three Salicylate Detergents*

| | Example: | | | |
|---|---|---|---|---|
| | 4.1 Detergent System A | 4.2 Detergent System B | 4.3 Detergent System A | 4.4 Detergent System B |
| Dispersant/inhibitor performance additive package | 12.8 | 12.8 | 12.7 | 12.7 |
| Hydrotreated Base Stock | 0.0 | 0.0 | 34.6 | 44.0 |
| PAO Base Stock | 72.1 | 71.2 | 40.9 | 32.5 |
| Hydrocarbyl Aromatic | 7.2 | 7.0 | 7.0 | 5.5 |
| Properties | | | | |
| SAE Grade | 5W-30 | 5W-30 | 5W-30 | 5W-30 |
| KV at 100° C., cSt | 12.0 | 12.0 | 9.6 | 9.9 |
| CCS at −30° C., cP | 6350 | 6400 | 6070 | |
| CCS at −35° C., cP | | | | 7270 |
| Performance | | | | |
| Ring Sticking Improvement over Base | Base | 1.25 | Base | 0.82 |
| Piston Merit Improvement over Base | Base | 8 | Base | 4.2 |

*detergents described herein contain approximately 50% process oil

Example 11

Noack Volatility/Viscosity Increase Evaluations

Noack testing was performed on a series of oils as shown in Table 5. The results again clearly show the unexpected results that can be obtained using a three-way mixture of low TBN, medium TBN, and high TBN calcium salicylates when directly compared to either of several detergents tested alone, of when binary mixtures of detergents were evaluated. Column 1, versus column 2 data, versus column 3 data, versus column 6 data, versus column 7 data clearly show the superiority of the three-way mixture of low TBN, medium TBN, and high TBN calcium salicylates when compared to binary mixtures of calcium salicylates or binary mixtures of calcium salicylates with magnesium salicylate added as a third component. Key results clearly showing improvement are the viscosity increase numbers, with column 1 exhibiting the surprisingly lowest increase in viscosity with a value of only 9.5% increase in viscosity.

The viscosity increase is determined by measuring the kinematic viscosity at 40° C. of an oil after a 3-hour Noack test and comparing this result to the kinematic viscosity at 40° C. of the new oil. A low viscosity increase is desired and reflects a resistance to oil thickening during engine operation.

The three-way mixture of neutral, low TBN, and high TBN calcium salicylates of column 5.1 was also compared to the phenate of column 5.4 used at a concentration of 8%. The results clearly show the unexpected superiority of the three-way mixture of low TBN, medium TBN and high TBN calcium salicylates.

The three-way mixture of low TBN, medium TBN, and high TBN calcium salicylates of column 5.1 was compared to a mixture of high and low TBN calcium sulfonates as exemplified by column 5.5. The results clearly show the unexpected superiority of the three-way mixture of neutral, low TBN, and high TBN calcium salicylates when compared to the use of a much higher total concentration of 10% of mixed calcium sulfonates.

These data clearly show the unexpected superiority of the mixed detergent systems and hydrocarbyl aromatic mixture(s) when compared to known prior art in a number of critical lubricant performance areas.

TABLE 5

Viscosity Increase as a Function of Detergent*.

| | Example: | | | | | | |
|---|---|---|---|---|---|---|---|
| | 5.1 | 5.2 | 5.3 | 5.4 | 5.5 | 5.6 | 5.7 |
| High TBN Ca Salicylate | 2.5 | 0.0 | 0.0 | 0.0 | 0.0 | 0.0 | 0.0 |
| Low TBN Ca Salicylate | 1.0 | 0.0 | 15.0 | 0.0 | 0.0 | 1.4 | 1.7 |
| Medium TBN Ca Salicylate | 1.0 | 5.8 | 0.0 | 0.0 | 0.0 | 4.2 | 5.2 |
| Low TBN Phenate | 0.0 | 0.0 | 0.0 | 8.5 | 0.0 | 0.0 | 0.0 |
| Neutral Sulfonate | 0.0 | 0.0 | 0.0 | 0.0 | 7.0 | 0.0 | 0.0 |
| 300 TBN Sulfonate | 0.0 | 0.0 | 0.0 | 0.0 | 3.0 | 0.0 | 0.0 |
| High TBN Mg Salicylate | 0.0 | 0.0 | 0.0 | 0.0 | 0.0 | 0.6 | 0.0 |
| Dispersant/inhibitor performance package | 13.9 | 13.9 | 13.9 | 13.9 | 13.9 | 13.9 | 13.9 |
| Hydrocarbyl aromatic | 8.6 | 8.6 | 8.6 | 8.6 | 8.6 | 8.6 | 8.6 |
| PAO Base Stock | 73.0 | 71.7 | 62.5 | 69.0 | 67.5 | 71.3 | 70.6 |
| Properties | | | | | | | |
| KV at 40° C. | 77.6 | 76.6 | 81.8 | 81.8 | 82.1 | 74.0 | 74.5 |
| KV at 100° C. | 13.8 | 13.6 | 14.3 | 14.1 | 14.3 | 13.2 | 13.2 |
| CCS at −30° C. | | | | | | 3400 | 3500 |
| CCS at −35° C. | 5500 | 5700 | 7300 | 7100 | 6800 | | |
| Performance | | | | | | | |
| KV increase (40° C.), % after 3 hour Noack | 9.5 | 62.1 | 71.6 | 10.7 | 18.9 | 49.0 | 63.8 |

*detergents described herein contain approximately 50% process oil

Examples of lubricant compositions in Table 6 illustrate the instant invention, with such compositions not limiting the invention.

TABLE 6

Lubricant Composition with Mixed Salicylate Detergents *

| | Example: | | | | | | | |
|---|---|---|---|---|---|---|---|---|
| | 6.1 | 6.2 | 6.3 | 6.4 | 6.5 | 6.6 | 6.7 | 6.8 |
| High TBN Ca Salicylate | 1.5 | 2 | 2 | | 2.5 | 1 | 1 | |
| Low TBN Ca Salicylate | 1.0 | 2 | | 2 | 1.0 | 2 | | 3 |
| Medium TBN Ca Salicylate | 1.0 | | 1 | 1 | 1.0 | | 2 | 0.5 |
| Dispersant/ inhibitor performance package | 13.9 | 13.9 | 13.9 | 13.9 | 13.9 | 13.9 | 13.9 | 13.9 |
| HDT 4 ** | | | bal | | bal | bal | | |
| PAO 4 ** | | bal | | | | | bal | |
| GpIII 4 ** | bal | | | bal | | | | bal |
| Ester | | 10 | | 2 | 5 | | 5 | |
| 150N Grp I base stock | 3 | | | 10 | | 8 | 5 | |
| Hydrocarbyl aromatic | 10 | 3 | 15 | | 7 | 15 | 6 | 18 |

* detergents described herein contain approximately 50% process oil
** HDT 4, PAO 4, GpIII 4 are defined in Table 2.

All U.S. Patents, non-U.S. patents and applications, and non-patent references cited in this application are hereby incorporated in their entirety by reference.

What is claimed is:

1. A method to improve piston cleanliness and coefficient of friction in an internal combustion engine comprising (a) obtaining a lubricating oil composition comprising a first calcium salicylate detergent having a TBN of over about 200, present in an amount of about 0.2 to about 4 weight percent of the lubricating oil composition on an active ingredient basis, a second calcium salicylate detergent having a TBN between about 100 and 200, present in an amount of about 0.2 to about 4 weight percent of the lubricating oil composition on an active ingredient basis, and a third calcium salicylate detergent having a TBN less than about 100, present in an amount of about 0.2 to about 4 weight percent of the lubricating oil composition on an active ingredient basis, and any combination thereof, (b) lubricating the internal combustion engine, and (c) maintaining in the internal combustion engine a coefficient of friction less than 0.1 between 100 and 180° C. and a film cleanliness less than 10% between 100° C. and 180° C.

2. The lubricating oil composition of claim 1 further comprising a hydrocarbyl aromatic fluid.

3. The lubricating oil composition of claim 2 wherein the oil of lubricating viscosity has a viscosity index of about 110 or greater.

4. The lubricating oil composition of claim 3 wherein the oil of lubricating viscosity is at least one item selected from the group consisting of Group II base stocks, Group III base stocks. Group IV base stocks, and wax isomerates, and mixtures thereof.

5. The lubricating oil composition of claim 4 wherein the wax isomerate base stock is a hydroisomerized Fischer-Tropsch wax.

6. The lubricating oil composition of claim 4 wherein the hydrocarbyl aromatic fluid is present in an amount of about 3 to 30 weight percent of the lubricating oil composition.

7. The lubricating oil composition of claim 6 wherein the salicylates are each present in an amount of about 0.25 to about 2 weight percent of the lubricating oil composition on an active ingredient basis, and the hydrocarbyl aromatic fluid is present in an amount of about 4 to 20 weight percent of the lubricating oil composition.

8. The lubricating oil composition of claim 7 wherein at least 20 weight percent of the lubricating oil composition is comprised of at least one item selected from a group consisting of Group II base stocks, Group III base stocks, and wax isomerate base stocks and mixtures thereof.

9. The lubricating oil composition of claim 8 wherein at least 30 weight percent of the lubricating oil composition is comprised of at least one item selected from a group consisting of Group II base stocks, Group III base stocks, and wax isomerate base stocks and mixtures thereof.

10. The lubricating oil composition of claim 9 wherein at least 80 weight percent of the lubricating oil composition is comprised of at least one item selected from a group consisting of Group II base stocks, Group III base stocks, and wax isomerate base stocks and mixtures thereof.

11. The method of claim 1 further comprising improving the viscosity increase of a lubricating oil composition in a 3-hour Noack test.

12. The method of claim 1 further comprising improving ring sticking of a lubricating oil composition.

13. The method of claim 1 further comprising improving the low temperature CCS properties of a lubricating oil composition.

* * * * *